United States Patent [19]

Murari et al.

[11] Patent Number: 5,036,269

[45] Date of Patent: Jul. 30, 1991

[54] VOLTAGE STABILIZER WITH A VERY LOW VOLTAGE DROP DESIGNED TO WITHSTAND HIGH VOLTAGE TRANSIENTS

[75] Inventors: Bruno Murari, Monza; Marco Morelli, Leghorn; Giampietro Maggioni, Cornaredo, all of Italy

[73] Assignee: SGS-Thomson Microelectronics Srl, Brianza, Italy

[21] Appl. No.: 458,373

[22] Filed: Dec. 28, 1989

[30] Foreign Application Priority Data

Dec. 28, 1988 [IT] Italy ..... 23114 A/88 1/595

[51] Int. Cl.[5] ..... G05F 1/55

[52] U.S. Cl. ..... 323/266; 323/270; 323/275; 323/303

[58] Field of Search ..... 323/266, 268, 270, 273, 323/274, 275, 276, 280, 281, 299, 303; 361/18

[56] References Cited

U.S. PATENT DOCUMENTS

| | | | |
|---|---|---|---|
| 3,443,203 | 5/1969 | Krayenbrink | 323/266 |
| 3,828,240 | 8/1974 | Keller et al. | 323/281 |
| 4,543,522 | 9/1985 | Moreau | 323/274 |
| 4,754,388 | 6/1988 | Pospisil | 323/266 |
| 4,792,747 | 12/1988 | Schroeder | 323/274 |
| 4,890,003 | 12/1989 | Seibert et al. | 323/266 |

*Primary Examiner*—Peter S. Wong

*Attorney, Agent, or Firm*—Wenderoth, Lind & Ponack

[57] ABSTRACT

A voltage stabilizer with a very low voltage drop includes a series voltage regulator circuit having a first PNP transistor connected to an input terminal of the stabilizer via a second PNP transistor and being connected to ground via a capacitor. The stabilizer has biasing and switching circuits disposed between the input terminal thereof, a base terminal of the second transistor and ground.

5 Claims, 2 Drawing Sheets

VOLTAGE STABILIZER WITH A VERY LOW VOLTAGE DROP DESIGNED TO WITHSTAND HIGH VOLTAGE TRANSIENTS

BACKGROUND OF THE INVENTION

The present invention relates to voltage stabilizer devices and in particular to monolithically integrated voltage stabilizers which can be used in automobile applications or for portable apparatus.

Voltage stabilizers supply a voltage having a well-specified and constant value or values from a voltage having an indeterminate value which is supplied to them.

Voltage stabilizers can be advantageously used as supply devices for other devices; they supply the current required as a function of the load connected to them so that the voltage supplied to this load always remains constant.

At present, for reasons of compactness, ease of use and economic viability, the voltage stabilizers produced for all fields of application tend to be of the electronic integrated circuit type.

In general, the magnitudes of the voltage and current at the output terminals of these electronic voltage stabilizers are determined by an internal regulation circuit comprising a feedback circuit means connected to the output terminals and sensitive to the instantaneous value of these magnitudes.

The lower limit of the field of correct operation of an electronic voltage stabilizer is ascertained from a parameter which is generally known in the technical literature by the term "drop-out", which is the difference between the minimum value of the input voltage required for correct operation of the stabilizer and the value of the constant output voltage which the stabilizer has to supply and thus indicates the voltage drop across the device. For instance, the voltage stabilizers used in automobile applications have to meet very severe requirements as a result of operating conditions which may involve both substantial temperature and humidity variations and substantial, occasionally abrupt, variations in the supply voltage supplied by the motor vehicle battery.

These stabilizers must therefore be very reliable, accurate and stable, while at the same time being economically viable, and must in particular have a low drop-out since the supply voltage supplied by the battery of a motor vehicle may normally drop, during cold starting, from the typical 14.4 V at full charge to some 6 V.

Account must also be taken of the positive and negative voltage peaks having a maximum amplitude of up to 150 V which may be present on the supply line of a motor vehicle as a result of the switching transients of inductive loads (ignition coils, relays, etc.) or electrical connection cable detachments or breakages.

The monolithically integrated voltage stabilizer circuits most commonly used for automobile applications are those with so-called "series"-type regulation, in which the output voltage is regulated to a constant value by a bipolar power transistor connected in series to an output terminal and suitably base-controlled to cause it to conduct as a function of the load.

A suitably dimensioned power transistor may even withstand, with no drawbacks, positive voltage peaks having a high amplitude and thus continue to ensure the regulation of the output voltage.

The negative peaks of the input voltage could, however, cause the transistor to be cut off, thereby causing interruptions, albeit brief, in the supply to the consumer circuits connected to the voltage stabilizer, with serious drawbacks when these comprise integrated memories and logic circuits which require a constant supply.

For this reason, voltage stabilizers comprising "series"-type regulation circuits also comprise a capacitor and an input diode, which are not integrated, so that a sufficient supply to the power transistor can be maintained during very short negative transients in the input voltage.

FIG. 1 of the drawings shows the known diagram of a voltage stabilizer with "series"-type regulation obtained by PNP power transistors.

The circuit diagram of FIG. 1 comprises a bipolar PNP transistor T having its emitter terminal connected to the cathode of a diode D, whose anode forms an input terminal IN, and to a first terminal of a capacitor C whose second terminal is connected to ground. The collector terminal of the transistor T forms an output terminal OUT.

The base terminal of the transistor T is connected to the output terminal of a differential amplifier A whose non-inverting input is connected via a first resistor $R_1$ to the terminal OUT and is connected via a second resistor $R_2$ to ground.

The inverting input of the amplifier is, in contrast, connected to a voltage reference $V_R$.

The part of the diagram of FIG. 1 which represents the voltage regulator circuit which can be monolithically integrated is enclosed in a rectangular block of dashed lines.

The capacitor C is charged via the diode D to the typical values of the battery voltage less the voltage drop across the diode itself, during normal charging conditions.

However, during negative voltage transients the diode D prevents the capacitor C from discharging via the input terminal with the result that this capacitor can discharge only via the transistor of the regulation circuit, allowing it to conduct during the transient itself.

In the case of a stabilizer comprising a PNP power transistor, there is a drop out:

$$V_{DROP}=V_D+V_{CE\,sat}$$

in which $V_D$ is the voltage drop across the diode D when conducting and $V_{CE\,sat}$ is the collector-emitter voltage of the transistor T when it is at saturation.

Using an NPN power transistor, it is possible to achieve, with the same drop-out, an integration area occupation on the part of the regulation circuit which is lower than that which can be obtained with a PNP power transistor.

FIG. 2 shows the diagram of a voltage stabilizer comprising a bipolar NPN power transistor $T'_1$ whose collector terminal is connected to the cathode of a diode D' and to a first terminal of a capacitor C', the second terminal of which is connected to ground.

The circuit diagram also comprises first and second bipolar PNP transistors $T'_2$ and $T'_3$, both having their collector terminals connected to the base terminal of the transistor $T'_1$. The emitter terminal of the transistor $T'_2$ is connected to the cathode of the diode D' and the emitter terminal of the transistor $T'_3$ is connected to the anode of the diode D' in a circuit node which forms an input terminal IN' of the stabilizer.

The emitter terminal of the transistor $T'_1$ forms an output terminal OUT'.

The base terminal of the transistor $T'_1$ is connected to the output terminal of a differential amplifier A' whose inverting input is connected to the output terminal OUT' via a first resistor $R'_1$ and is connected to a common terminal GND' via a second resistor $R'_2$. This common terminal GND' is connected to ground.

The non-inverting input of the differential amplifier is connected to a voltage reference $V'_R$.

The base terminal of the transistor $T'_2$ is connected to the common terminal GND' via a first constant current generator $G'_2$ and is connected to the cathode of a diode $D'_2$ whose anode is connected to the emitter terminal of the transistor $T'_2$.

The base terminal of the transistor $T'_3$ is connected to the common terminal GND' via a second constant current generator $G'_3$ and is connected to the cathode of a diode $D'_3$ whose anode is connected to the emitter terminal of the transistor $T'_3$.

The regulation circuit which can be monolithically integrated is also enclosed in a rectangular block of dashed lines in FIG. 2.

The drop-out of the voltage stabilizer described here has a value:

$$V_{DROP}=V_{BE}+V_{CE\,sat'}$$

in which $V_{BE}$ is the base-emitter voltage of the transistor $T'_1$ in conduction, with a value approximately equal to the voltage drop $V_D$ at a diode and $V_{CE\,sat'}$ is the collector-emitter voltage of the transistor $T'_3$ when it is at saturation, this drop-out consequently being equal to that of the stabilizer shown in FIG. 1.

SUMMARY OF THE INVENTION

The object of the present invention is to provide a voltage stabilizer device which has a drop-out lower than that of known devices.

This object is achieved by providing a monolithically integratable voltage stabilizer comprising: a first bipolar transistor of a first type of conductivity having an emitter terminal which is connected to ground via a capacitor, and having a collector terminal which forms an output terminal of the stabilizer, and having a base terminal; a differential amplifier having an output terminal which is connected to said base terminal of said first bipolar transistor and having a first input terminal which is connected to a voltage divider connected between the output terminal of the stabilizer and ground, and having a second input terminal which is connected to a first voltage reference; a second bipolar transistor of said first type of conductivity having an emitter terminal which forms an input terminal of said first transistor and having a base terminal which is connected to a biasing and switching circuit means disposed between said base terminal of said first transistor and ground and said input terminal of the stabilizer.

BRIEF DESCRIPTION OF THE DRAWINGS

The invention is set out in detail in the following description, given purely by way of non-limiting example, with reference to the attached drawings, in which.

Figure 1:
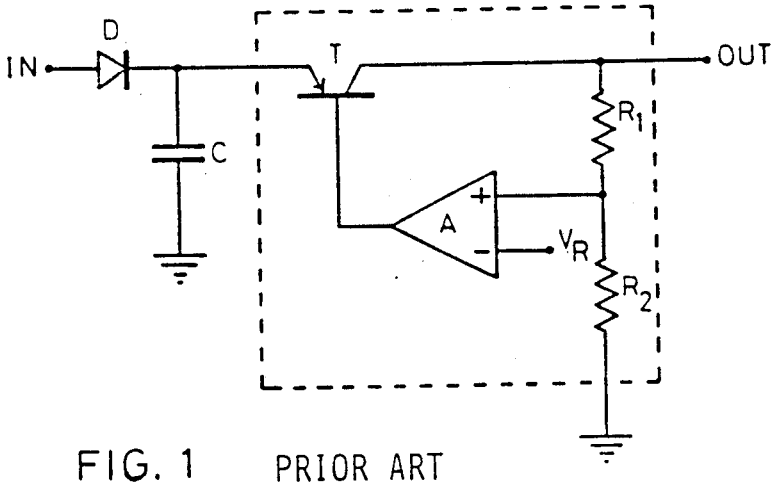
FIG. 1 PRIOR ART
FIG. 1 is the above-described circuit diagram of a prior art voltage stabilizer with a "series"-type regulation circuit, comprising a PNP power transistor.
Figure 2:
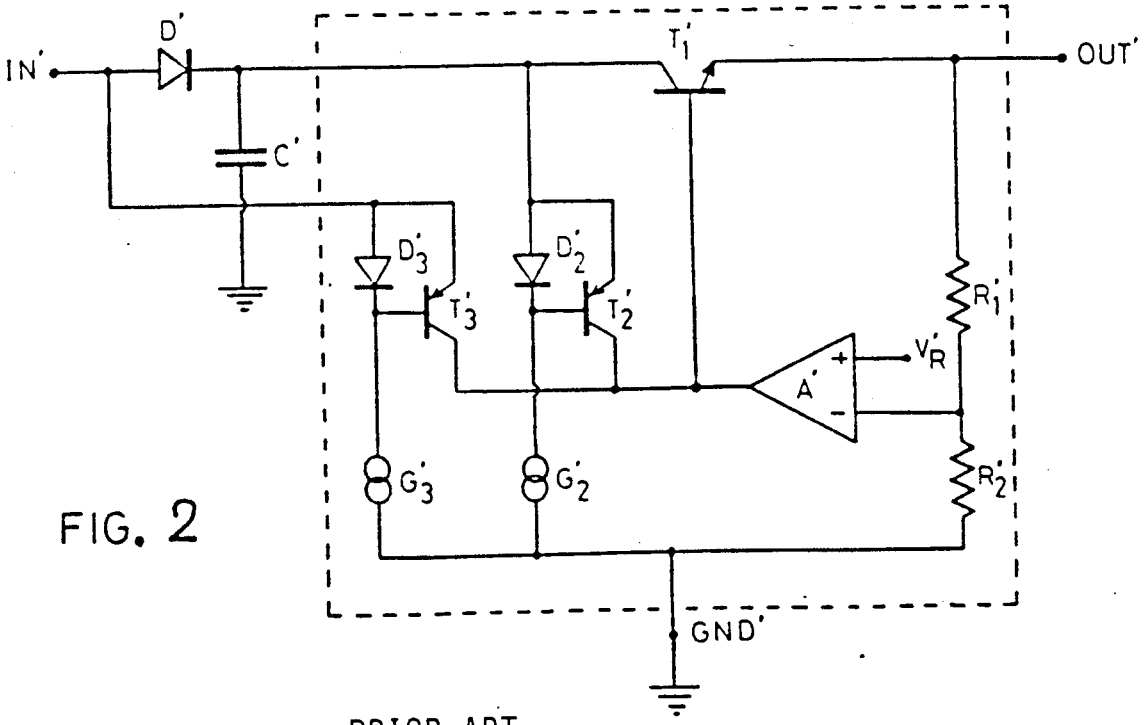
FIG. 2 PRIOR ART
FIG. 2 is the above-described circuit diagram of a prior art voltage stabilizer with a low drop-out comprising an NPN power transistor.

The same reference letters and numerals are used in the drawing figures for corresponding components.

DESCRIPTION OF THE PREFERRED EMBODIMENT

Figure 3:
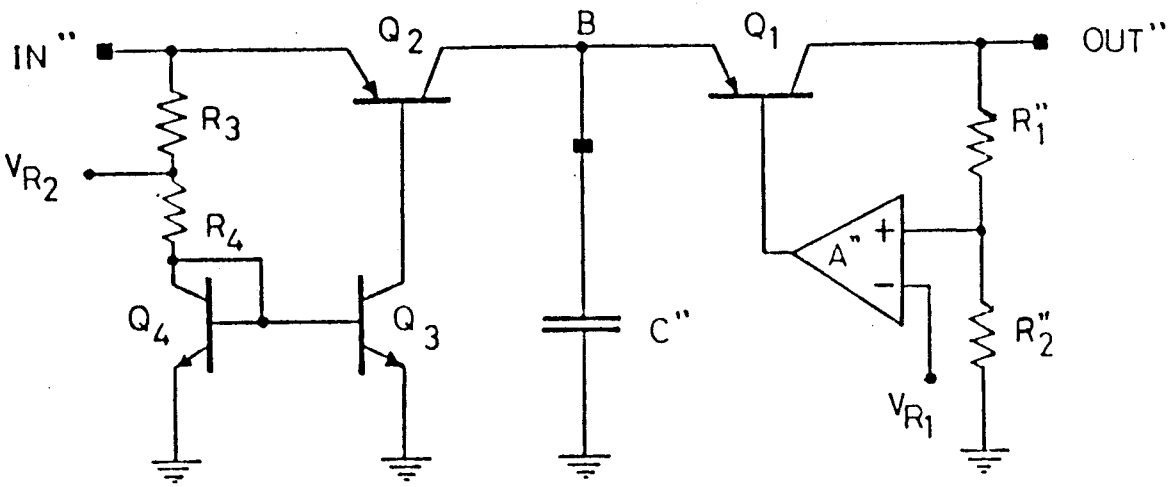
FIG. 3 is the circuit diagram of a preferred embodiment of a voltage stabilizer in accordance with the present invention.

The circuit diagram of a voltage stabilizer in accordance with the present invention, shown in FIG. 3, comprises first and second bipolar PNP transistors $Q_1$ and $Q_2$.

The emitter terminal of the transistor $Q_2$ forms an input terminal IN" of the stabilizer; the collector terminal of the transistor $Q_1$ forms an output terminal OUT".

The collector terminal of the transistor $Q_2$ is connected to the emitter terminal of the transistor $Q_1$ at a circuit node B which is connected to ground via a capacitor C".

The base terminal of the first transistor $Q_1$ is connected to the output terminal of a differential amplifier A" whose inverting input is connected via a first resistor $R'_1$ to the collector terminal of the transistor $Q_1$ and is connected via a second resistor $R'_2$ to ground.

The circuit diagram of FIG. 3 also comprises a biasing and switching circuit means inserted between the base terminal of the transistor $Q_2$, the input terminal IN" and ground.

The biasing and switching circuit means comprises third and fourth NPN transistors $Q_3$ and $Q_4$.

The emitter terminals of $Q_3$ and $Q_4$ are both connected to ground. The base and collector terminals of the transistor $Q_4$ are both connected to the base terminal of the transistor $Q_3$ in a current mirror circuit configuration.

The collector terminal of the transistor $Q_3$ is connected to the base terminal of the transistor $Q_2$, while the collector terminal of the transistor $Q_4$ is connected to the input terminal IN" via third and fourth resistors $R_3$ and $R_4$ connected in series. The connection node between these resistors is connected to a second voltage reference $VR_{R2}$.

As is immediately evident, the drop-out of a voltage stabilizer in accordance with the present invention has a value:

$$V_{DROP}=V_{CE\,sat\,Q1}+V_{CE\,sat\,Q2},$$

i.e. it is equal to the sum of the collector-emitter voltages of the transistors $Q_1$ and $Q_2$ when they are at saturation, and is thus lower than the drop-out of the known voltage stabilizers described above.

According to the present invention, the biasing and switching circuit means are designed to supply the base of the transistor $Z_2$ when the voltage supplied to the input terminal of the stabilizer remains higher than or equal to the sum of the voltage actually regulated as output and the voltage drop $V_{DROP}$ of the stabilizer, i.e.

$$V_{IN''}\geqq V_{OUT''}+2\,V_{CE\,sat'}$$

and to open the connection between the base terminal of the transistor $Q_2$ and ground when the voltage supplied to the input no longer allows normal operation of the stabilizer.

In this way, during negative peaks of the input voltage, due as we have seen to accidental reasons, the opening of the connection between the base terminal of the transistor $Q_2$ and ground prevents the base-collector junction of the transistor $Q_2$ from being forwardly biased and forming a channel for the discharging to ground of the capacitor C''.

In this way, the capacitor C'' can discharge only via $Q_1$, keeping the node B at a potential sufficient for normal operation of the output regulation circuit during the entire period of the input voltage transient.

The current mirror circuit structure contained in the diagram of FIG. 3 embodies biasing and switching circuit means controlled by the input voltage by means of the resistors $R_3$ and $R_4$ which, together with the voltage reference $V_{R2}$, establish the value of the current flowing in the transistor $Q_4$.

The transistor $Q_3$ is simultaneously a current generator for the supply of the transistor $Q_2$ and an electronic switch for the opening of the connection between the base terminal of the transistor $Q_2$ and ground when the supply to this transistor is cut off.

These biasing and switching circuit means can obviously be embodied in other ways known to persons skilled in the art, for instance by selecting and dimensioning the circuit components so that the switch opens automatically at specific input potential values in the presence of both negative and positive voltage peaks.

In this case, a voltage stabilizer circuit structure in accordance with the present invention comprising two PNP transistors in series between the input and output, in addition to having a drop-out which is lower than that of known stabilizers, is particularly suited to technological implementing solutions which allow the device to be very reliable under all conditions of use without substantial cost increases.

If the transistor $Q_2$ is cut off at both positive and negative input voltage peaks and its base connection is opened on cut-off, the transistor $Q_1$, as a result of the capacitor C, is subjected to voltages having normal values whatever the input voltage.

The transistor $Q_1$ can consequently be embodied as a PNP transistor with an isolated vertical collector which does not withstand high voltage transients but occupies a limited integration area.

The transistor $Q_2$ can in contrast be a normal lateral PNP transistor as a result of the fact that the base contact is opened precisely at the negative input peaks which thus avoids both inverse conduction of the transistor and conduction via the collector-emitter junction.

The increased integration area occupation by the lateral PNP transistor may entail increased costs, but these are offset by the very low drop-out which can be obtained.

Although a single embodiment of the invention has been described and illustrated, many variants are obviously possible, without departing from the scope of the invention.

What is claimed is:

1. A monolithically integratable voltage stabilizer comprising:

a first bipolar transistor of a first type of conductivity having an emitter terminal which is connected to ground via a capacitor, and having a collector terminal which forms an output terminal of the stabilizer, and having a base terminal;

a differential amplifier having an output terminal which is connected to said base terminal of said first bipolar transistor and having a first input terminal which is connected to a voltage divider connected between said output terminal of the stabilizer and ground, and having a second input terminal which is connected to a first voltage reference;

a second bipolar transistor of said first type of conductivity having an emitter terminal which forms an input terminal of the stabilizer, and having a collector terminal which is connected to said emitter terminal of said first transistor and having a base terminal which is connected to a biasing and switching circuit means disposed between said base terminal of said second transistor and ground and said input terminal of the stabilizer.

2. A voltage stabilizer as claimed in claim 1, wherein said biasing and switching circuit means comprises a switch disposed between said base terminal of said second transistor and ground.

3. A voltage stabilizer as claimed in claim 2, wherein said switch comprises a transistor included in a current mirror circuit having an input branch connected both to a second voltage reference and to said input terminal of the stabilizer and having an output branch connected to said base terminal of said second transistor.

4. A voltage stabilizer as claimed in claim 2, wherein said biasing and switching circuit means comprises a threshold comparator circuit means for opening said switch when a potential at said input terminal of the stabilizer is lower than a first predetermined value and when it is greater than a second predetermined value.

5. A voltage stabilizer as claimed in claim 1, wherein said first transistor comprises a PNP transistor with an isolated vertical collector and wherein a second transistor comprises a lateral PNP transistor.

* * * * *